US009933153B2

(12) United States Patent
Mitchell

(10) Patent No.: US 9,933,153 B2
(45) Date of Patent: Apr. 3, 2018

(54) FAN AND LIGHT COMBINATION

(71) Applicant: Robert William Mitchell, Austin, TX (US)

(72) Inventor: Robert William Mitchell, Austin, TX (US)

( * ) Notice: Subject to any disclaimer, the term of this patent is extended or adjusted under 35 U.S.C. 154(b) by 135 days.

(21) Appl. No.: 14/752,199

(22) Filed: Jun. 26, 2015

(65) Prior Publication Data

US 2015/0377480 A1 Dec. 31, 2015

Related U.S. Application Data

(60) Provisional application No. 62/018,748, filed on Jun. 30, 2014.

(51) Int. Cl.

| | |
|---|---|
| ***F21V 33/00*** | (2006.01) |
| ***F21S 8/00*** | (2006.01) |
| ***F21V 21/02*** | (2006.01) |
| ***F21V 21/30*** | (2006.01) |
| ***F04D 29/00*** | (2006.01) |
| ***F04D 25/16*** | (2006.01) |
| *F21V 23/04* | (2006.01) |
| *F04D 25/08* | (2006.01) |
| *F21Y 103/33* | (2016.01) |
| *F21Y 115/10* | (2016.01) |

(52) U.S. Cl.

CPC ..... *F21V 33/0096* (2013.01); *F04D 25/166* (2013.01); *F04D 29/005* (2013.01); *F21S 8/033* (2013.01); *F21V 21/02* (2013.01); *F21V 21/30* (2013.01); *F04D 25/088* (2013.01); *F21V 23/045* (2013.01); *F21Y 2103/33* (2016.08); *F21Y 2115/10* (2016.08)

(58) Field of Classification Search

CPC ..... F21V 33/0096
USPC ..... 362/457, 249.06
See application file for complete search history.

(56) References Cited

U.S. PATENT DOCUMENTS

| | | | | |
|---|---|---|---|---|
| 9,258,855 | B1 * | 2/2016 | Mart | F21V 29/025 |
| 2006/0002110 | A1 * | 1/2006 | Dowling | F21K 9/00 362/249.05 |
| 2010/0060132 | A1 * | 3/2010 | Liu | F21V 29/02 313/46 |
| 2010/0134341 | A1 * | 6/2010 | Priest | H04L 12/282 341/176 |
| 2011/0089830 | A1 * | 4/2011 | Pickard | F21K 9/135 315/32 |
| 2012/0268936 | A1 * | 10/2012 | Pickard | F21K 9/90 362/249.02 |
| 2013/0100678 | A1 * | 4/2013 | Baxter | F21V 13/02 362/311.06 |
| 2013/0163273 | A1 * | 6/2013 | Ticktin | F21V 5/04 362/555 |

* cited by examiner

*Primary Examiner* — Toan Ly
(74) *Attorney, Agent, or Firm* — Cesari & Reed, L.L.P.; Kirk A. Cesari

(57) ABSTRACT

A lighting and fan combination device is disclosed where the lighting can be mounted on a housing of the fan. One or more light and fan combination members can be connected to a mount that allows the device to be mounted to a wall, ceiling, or other structure. The lighting component may be separable from the fan housing and can be interchanged with other types of lighting components. The lighting elements may be LEDs or other lighting elements.

17 Claims, 8 Drawing Sheets

FAN AND LIGHT COMBINATION

CROSS-REFERENCE TO RELATED APPLICATIONS

The present application is a nonprovisional of and claims priority to U.S. Provisional Patent Application No. 62/018,748, filed on Jun. 30, 2014, and entitled "Wall Mounted Fan with Light Fixture", the contents of which are hereby incorporated by reference in its entirety.

DETAILED DESCRIPTION

In the following detailed description of embodiments, reference is made to the accompanying drawings, which form a part hereof, and in which are shown by way of illustrations. Features of the various described embodiments may be combined, other embodiments may be utilized, and structural changes may be made without departing from the scope of the present disclosure. Further, features of the various figures, embodiments, and examples disclosed herein can be combined, exchanged, or removed without departing from the scope of the present disclosure.

Figure 1:
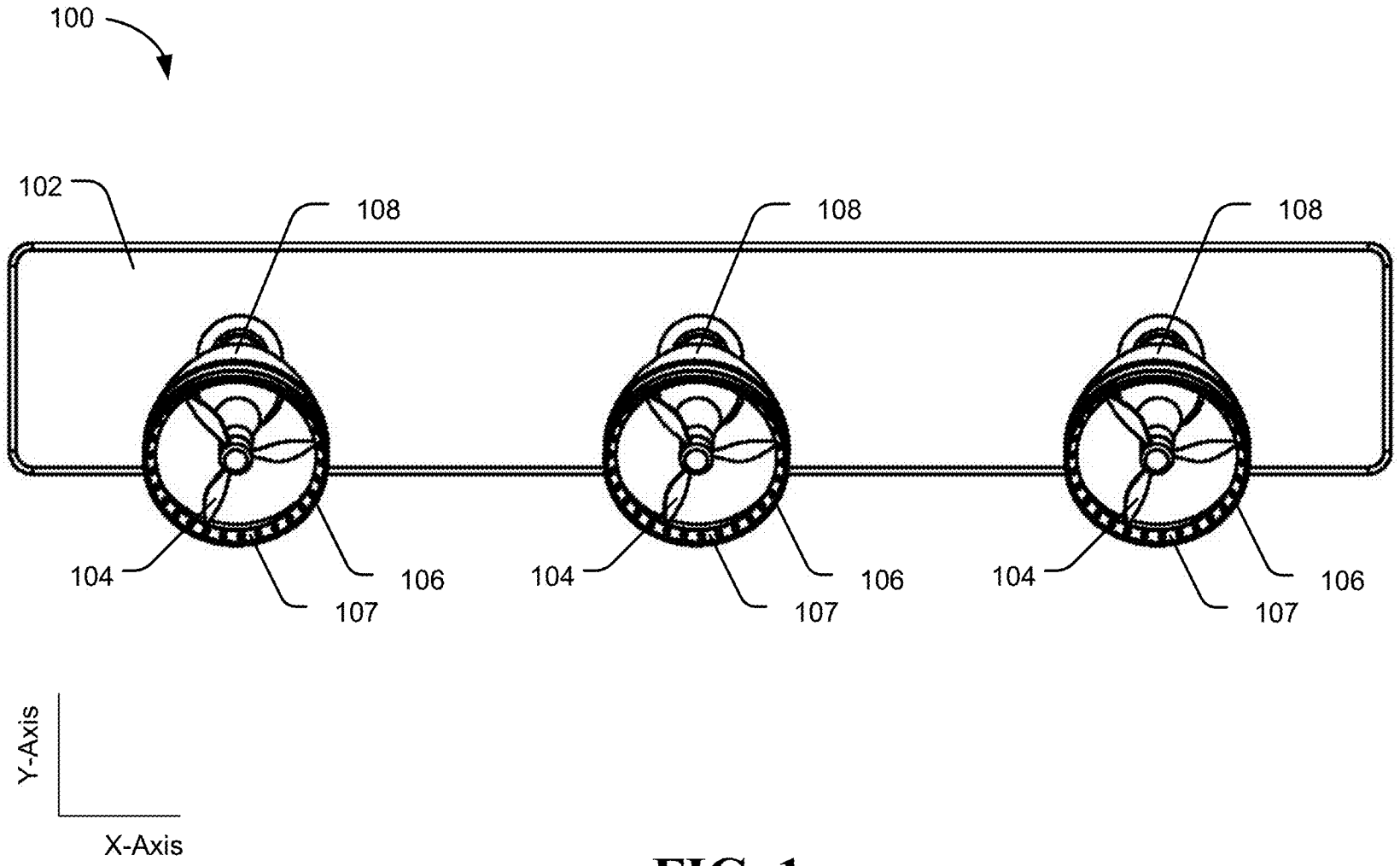
FIG. 1 is a diagram of a fan and light combination device, according to certain embodiments.

Referring to FIG. 1, a diagram of a fan and light combination device 100 is shown, in accordance with certain embodiments. The device 100 can include one or more fan and light combination member 108 that includes a fan 104 and light component 106. The fan and light combination member 108 may be attached to mount 102.

In some embodiments, the device 100 includes two or three fan light combination members 108. Further, more than three fan and light combination members 108 can be attached to the mount 102, which can be resized accordingly to accommodate different numbers of fan and light combination members 108.

The light component 106 may include one or more lighting element 107, such as a light emitting diode (LED). In some examples, the light component 106 may include multiple LEDs arranged around a rim 105 of the fan and light combination member 108. As shown, the light component 106 may have a generally annular shape; however, the shape of the light component 106 can vary to closely match or coincide with the shape of the rim 105, even when the rim 105 is other than a circular shape. For example, rim 105 may have a round (as shown), rectangular, square, elliptical, triangular, or other shape.

In certain embodiments, the lighting element(s) 107 may be located at other locations of the device 100 in addition to the rim 105 or instead of on the rim 105. For example, one or more lighting element(s) 107 may be located on the mount 102, or on other locations of the member 108, such as on the grill 115, the fan 104, or the housing 109. The lighting element(s) 107 can be located on an interior surface 116 or an exterior surface of the housing 109.

The proximate end of each fan and light combination member 108 can be connected to the mount 102, such as by ball and joint connector 103. The ball and joint connector 103 can be an articulable member to provide the fan and light combination member 108 a range of motion. The range of motion may be in one direction (such as up and down), multiple directions (such as up and down, and side to side), or a 360 degree range of motion to allow the member 108 to swivel within the joint connector 103. In other embodiments, each member 108, or some of the members 108, may be fixed to mount 102 in a stationary position.

Figure 2:
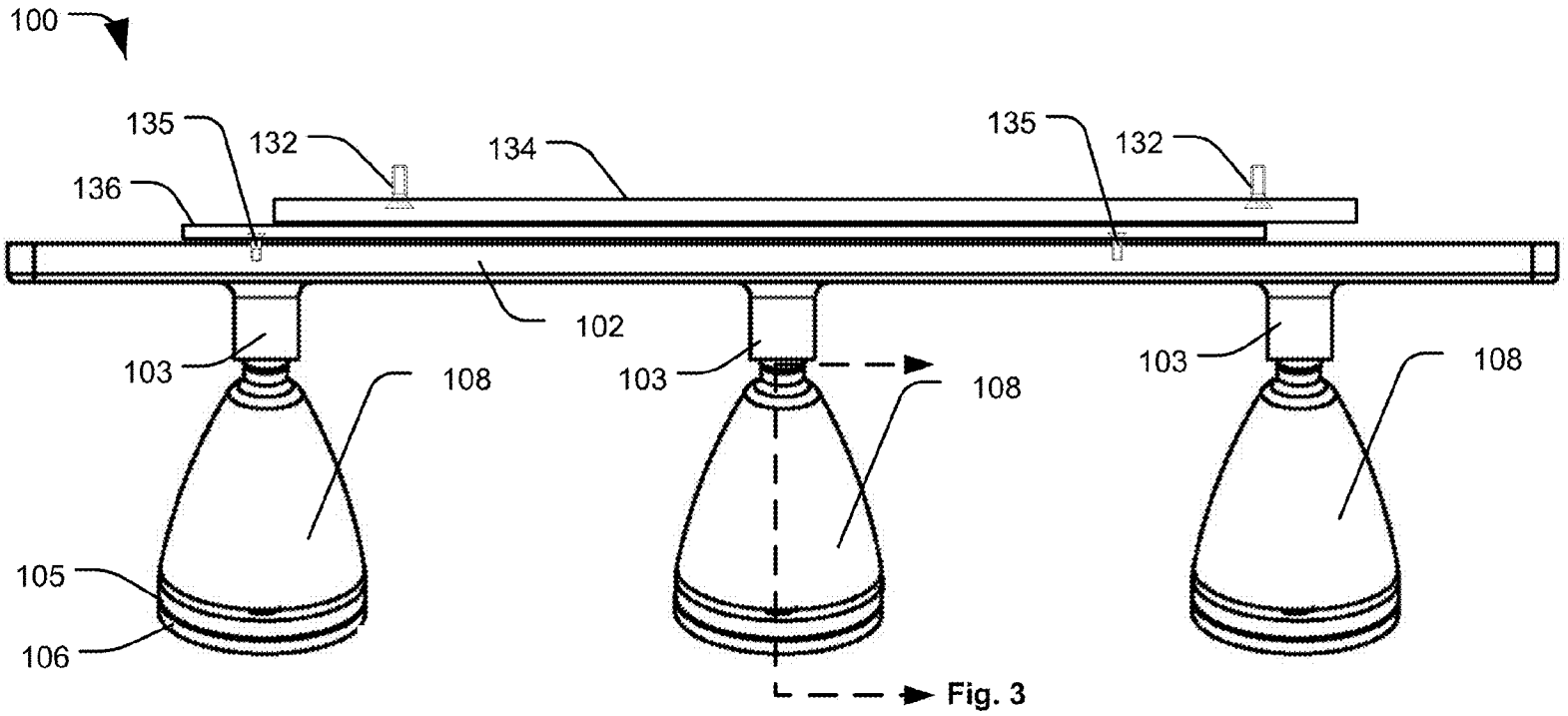
FIG. 2 is a diagram of a top view of a fan and light combination device, according to certain embodiments.

Referring to FIG. 2, a top view of the fan and light combination device 100 is shown, in accordance with certain embodiments. The mount 102 may be attachable to a wall plate 134 that allows the mount to be easily attached to a wall. The wall plate 134 may have multiple mounting holes or surfaces to allow the wall plate 134 to be mounted to a surface, such as by using screws 132 (or nails, adhesives, hook and loop fasteners, hooks, or other mounting hardware). In certain embodiments, the wall plate 134 can include a sliding plate 136 that movably attaches to the wall plate 134 (such as described later) and is attachable, via one or more attachment mechanisms 135 (such as screws, nails, adhesives, hook and loop fasteners, hooks, or other mounting hardware). While the mount 102 is discussed as attachable or mountable to a wall, it could also be attached or mounted to other surfaces, such as a ceiling, floor, door, or other device.

Figure 3:
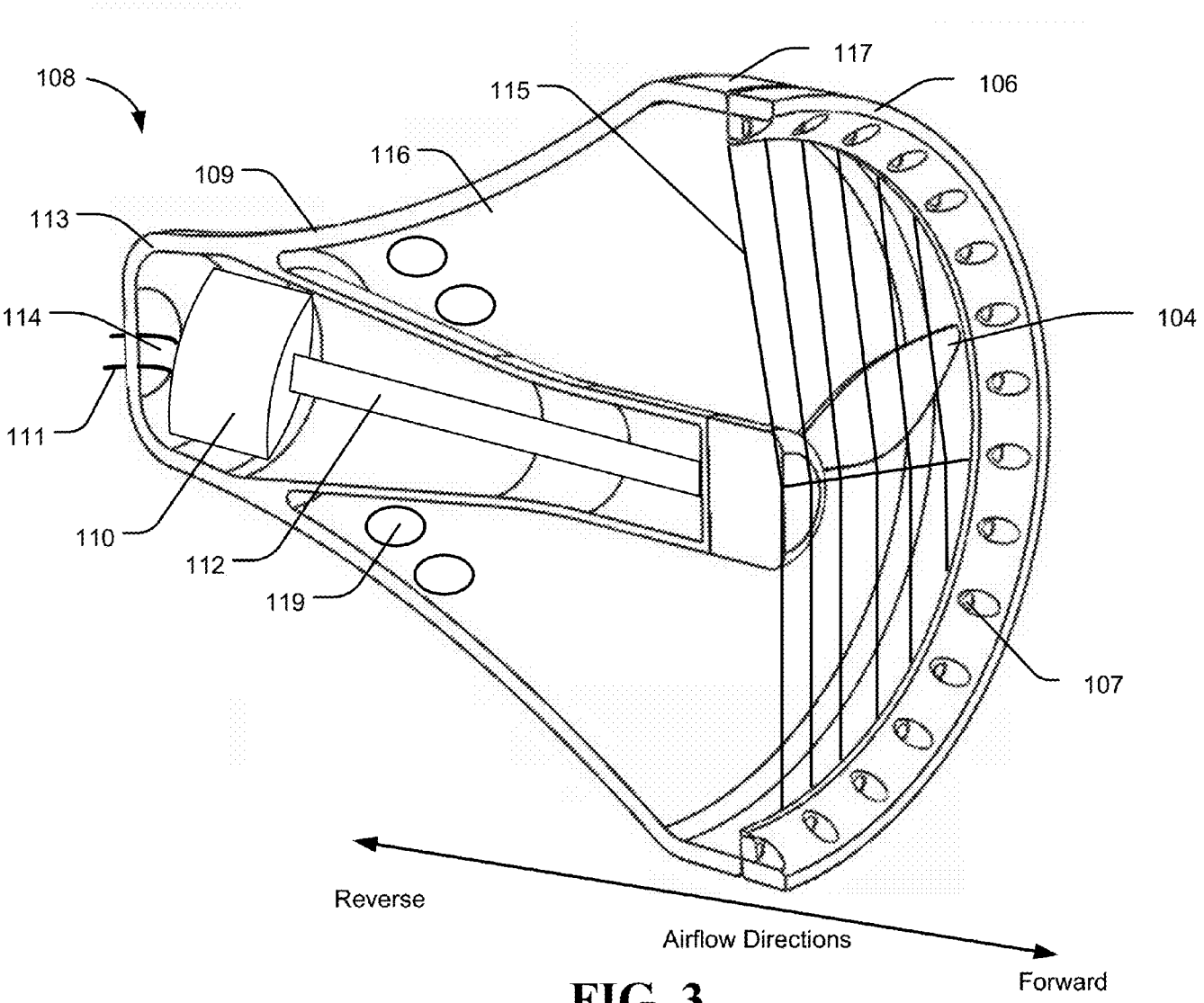
FIG. 3 is a diagram of a cross section of a single fan and light combination member, according to certain embodiments.

Referring to FIG. 3, a cross section of a single fan and light combination member 108 is shown, as from the perspective of the dashed line shown in FIG. 2, in accordance with certain embodiments. The member 108 may have a housing 109 having the fan 104 disposed therein. The housing may have a proximate end 113 and a distal end 117, with a housing side wall 116 disposed between the proximate end and the distal end. The proximate end 113 can include an opening 114 through which wires 111 can provide power and control signals, such as for the fan 104, lighting element 107, or both may pass through. The member 108 may also include a fan motor 110 which can drive a spindle 112 to rotate the fan 104. The fan motor 110 may be a variable speed motor, have variable directions, or both.

The light component 106 may be connected to the distal end 117 of the housing 109, such as at a rim 105 of the side wall 16, and the light member may substantially conform to a shape of the distal end 117. The light component 106 can be removably connected to, and thus removable from, the distal end 117 by an attachment mechanism, as described in FIG. 4. A front grill, grate, baffle, or other protection mechanism 115 may be disposed on the distal end 117, or on the lighting component 106 to protect the fan 104 from being easily accessible while also allowing displaced air from the fan 104 to pass through the first housing towards the distal end (i.e. out of the housing), as indicated by the arrow (though in some embodiments the motor may have a reverse setting to spin the fan in the other direction and thus reverse the airflow into the housing). The housing 109 may have one or more openings 119 for air to pass through, such openings 119 may allow for an increased amount of airflow through the housing 109. However, in some embodiments, there may not be any openings in the housing 109 other than the open front at the distal end 117 and the wiring opening 114 at the proximate end 113.

The light component 106 may be easily replaceable and may include custom light filters that are interchangeable. In addition, the light component 106 may include a motion sensor to turn on the lighting elements 107, though in some instances less than all of the lighting elements 107 may turn on (e.g. a lower intensity of light is turned on due to motion sensing than a user manually turning on the lighting elements). However, the motion sensor could be incorporated into the member 108 or the mount 102.

Further, the fan 104 may include replaceable fan blades. A user could easily disassemble the member 108 by removing a replaceable protection mechanism 115 (e.g. grill) and access the inner cavity of the member 108 to replace the fan blades. Different number of fan blades, such as three or four, can be installed, as well as different shaped fan blades (e.g. thinner versus wider, curved versus flat, convex versus concave, different angled blades, or any other known blade design). Further, as described below, the protection mechanism 115 may be replaceable with different types (e.g. grill, cross members, baffle, screen, etc.) Even further, the fan motor 110 may be accessible and replaceable.

In certain embodiments, the motor 110, electronics 120 and 122, switch(es)/control(s) 124, wires 111, fan 104, light elements 107, and any other component of the device 100 can include moisture resistant protection, such as rubber coatings, sealants, coverings, etc. For example, the fan 104 may have a sealed chamber in which motor 110 and spindle 112 are located. This can allow the device 100 to be humidity resistant or water resistant, which can be beneficial if the device 100 is installed in a bathroom, kitchen, or outdoors.

Figure 4:
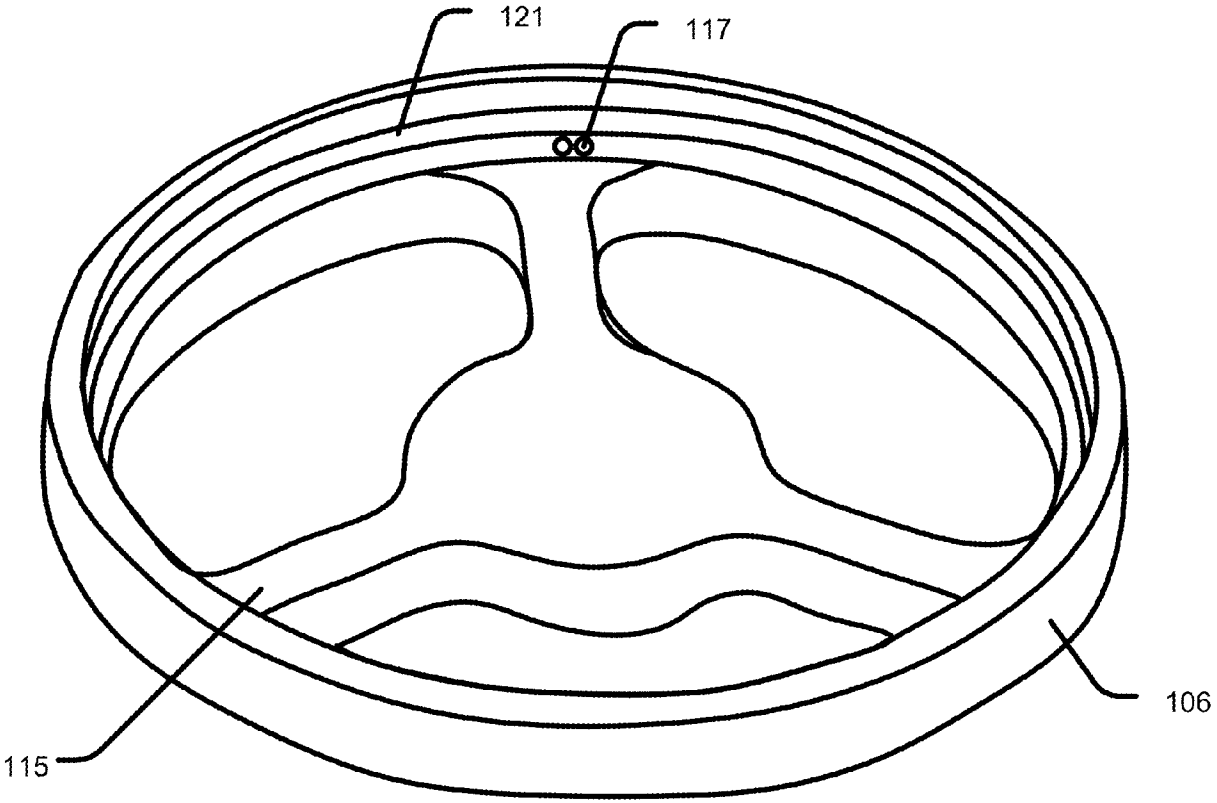
FIG. 4 is a diagram of a lighting system, according to certain embodiments.

Referring to FIG. 4, a diagram of a lighting component is shown, in accordance with certain embodiments. Specifically, an under surface of the light component 106 in some embodiments is shown. FIG. 4 shows the protection mechanism 115 as multiple crosspieces, whereas FIG. 3 showed the protection mechanism 115 as a grill; any style or type of protection mechanism for the fan may be used or none may be used. The protection mechanism 115 may be attached to the lighting component 106 or may be attached to the housing 109.

The light component 106 may have one or more electrical contact 117 included therein, such that when the light component is attached to the housing 109, power is provided to the light element 107 that is disposed on the top surface of the light component 106. The electrical contacts 117 can be disposed within the light member and adapted to contact electrical contacts on the housing 109, the electrical contacts providing electrical power connections to the one or lighting elements 107.

The lighting component 106 may also include an attachment mechanism 121, for example, a threaded element adapted to thread onto another threaded element of the housing 109. Other examples of attachment mechanism 121 that could be implemented include a snap in connector, a push pull locking connector, a quarter turn connector, one or more clips, or a combination thereof.

Further, the lighting component 106 may be separately packaged, distributed, and sold form the device 100. This can allow variations in light elements, such as color, intensity, or number to be packaged separately. In addition, the lighting component 106 may be made to be interchangeable on other devices, such as a flash light, lantern, lamp, cones lights, track lighting, or a standard bulb socket attachment.

Figure 5:
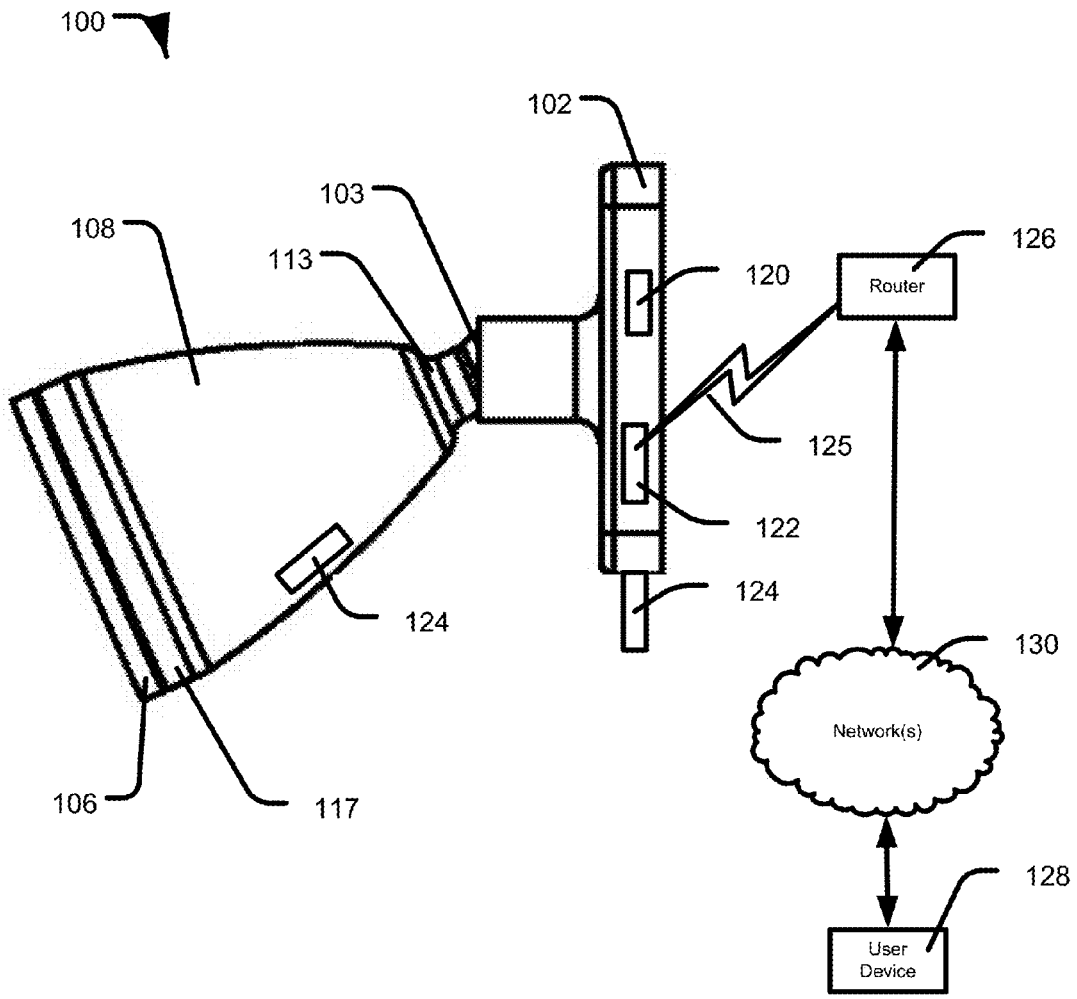
FIG. 5 is a diagram of a system including a fan and light combination, according to certain embodiments.
Figure 5:
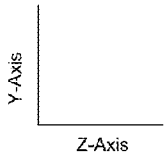

Referring to FIG. 5, a side view of the fan and light combination device 100 is shown, in accordance with certain embodiments. The device 100 may include one or more electric circuits, such as power source 120 or electronics 122, which can be incorporated into the mount 102, the member 108, or a combination thereof. Power source 120 may be any type of power source. For example, power source 120 may be an AC/DC converter that can receive power from a wall outlet, may be a battery, a solar cell and battery, or other power source.

Further, device 100 may have one or more switches or controls 124 on the mount 102 or the member 108, or both. For example, the control 124 can control light elements 107 that have multiple selectable settings that can vary in intensity emitted from the light elements 107; that is the control 124 may allow a user to brighten or dim the light elements 107. Also, the control 124 can allow a user to turn off a portion, less than all, off the light elements 107. Also, the control 124 may allow a user to change a color of the light element 107. For example, the lighting elements 107 may have multiple settings, such as for "Night", "Day", "Indoor", or "Outdoor" which can attempt to replicate light intensities based on location. The control 124 may also include a variable speed or direction fan switch. In some embodiments, the device 102 may have a remote control that transmits a signal directly to the electronics 122 and is adapted to control a light intensity, a mode, a color of light, or any combination thereof.

Electronics 122 may include one or more of a processor, hardware logic, a field programmable gate array (FPGA), circuits, a system-on-chip (SoC), integrated circuits, or any combination thereof. Electronics 122 can be configured to provide the device 100 with wireless connectivity, via wireless network 125, such as by including a Wi-Fi enabled chip. In some examples, the wireless network 125 may connect to a router 126 that can also connect to a network 130 to allow a user device 128 to communicate with the device 100. In some embodiments, the electronics 122 may include a wireless receiver, such as a Bluetooth enabled receiver, and an embedded speaker or a connection for a speaker. For example, one of the members 108 may be removed and replaced with an attachable speaker. In some cases, the speaker may have the wireless receiver built into it.

The user device 128 may include one or more software programs that are configured to control the device 100, such as control 124. For example, the user device, via software, can control a light intensity, a mode, a color of light, or any combination thereof. The software, functions, and processes described herein may be implemented as a computer memory or memory device storing instructions that when executed cause a processor to perform such processes or functions. The user device 128 may be a smartphone, laptop computer, desktop computer, tablet computer, smartwatch, or any other electronic device that can communicate via network and execute the software.

Figure 6:
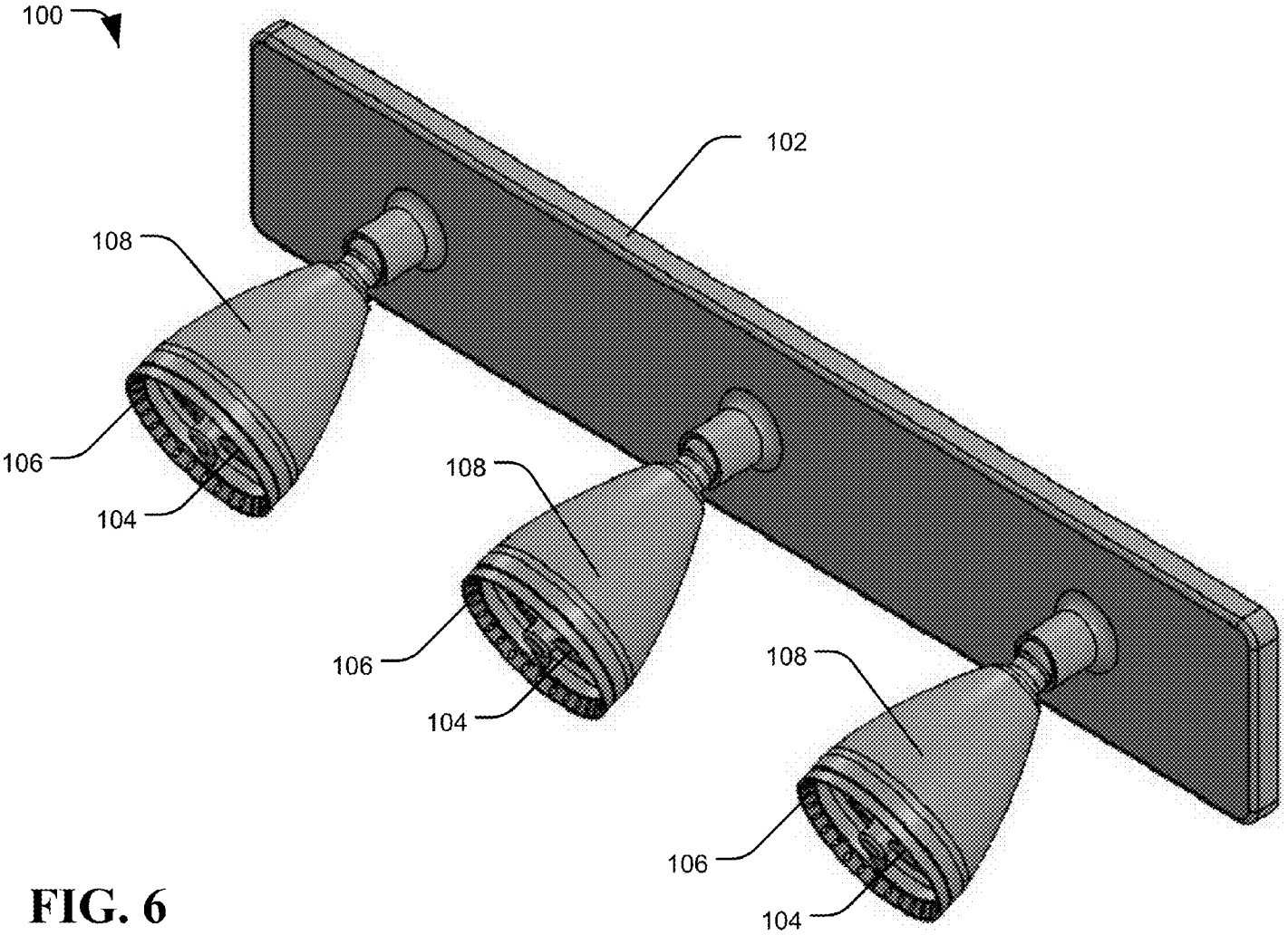
FIG. 6 is a diagram of a system including a fan and light combination, according to certain embodiments, according to certain embodiments.

Referring to FIG. 6, a three dimensional view of the fan and light combination device 100 is shown, in accordance with certain embodiments. As previously mentioned, the mount 102 may include wiring, and a voltage converter as needed, to provide power to the fan 105 and lighting element 107. The wiring may include wiring to mount the device 100 to an electrical junction box or to plug the device 100 into a wall outlet. Also, the mount 102 could include variable mounting plates to allow a user or installer to shift the mount 102 location along wall.

The junction 103 between the members 108 and the mount 102 may allow for each of the members to be separately removable from the mount 102. For example, a removable twist and turn interface can be adapted at the junction 103. In another example, a release adapted at the junction 103 can allow a ball to be removed from a joint socket. This can allow different lights or accessories, such as a speaker, to be installed. In certain embodiments, a ball joint can be implemented at the junction 103. The ball joint 103 can be adapted to allow wiring for the member 108 to run through the ball joint 103 and also allow the member 108 to be tilted approximately 180 degrees in any direction along the plane of the mount 102.

Figure 7:
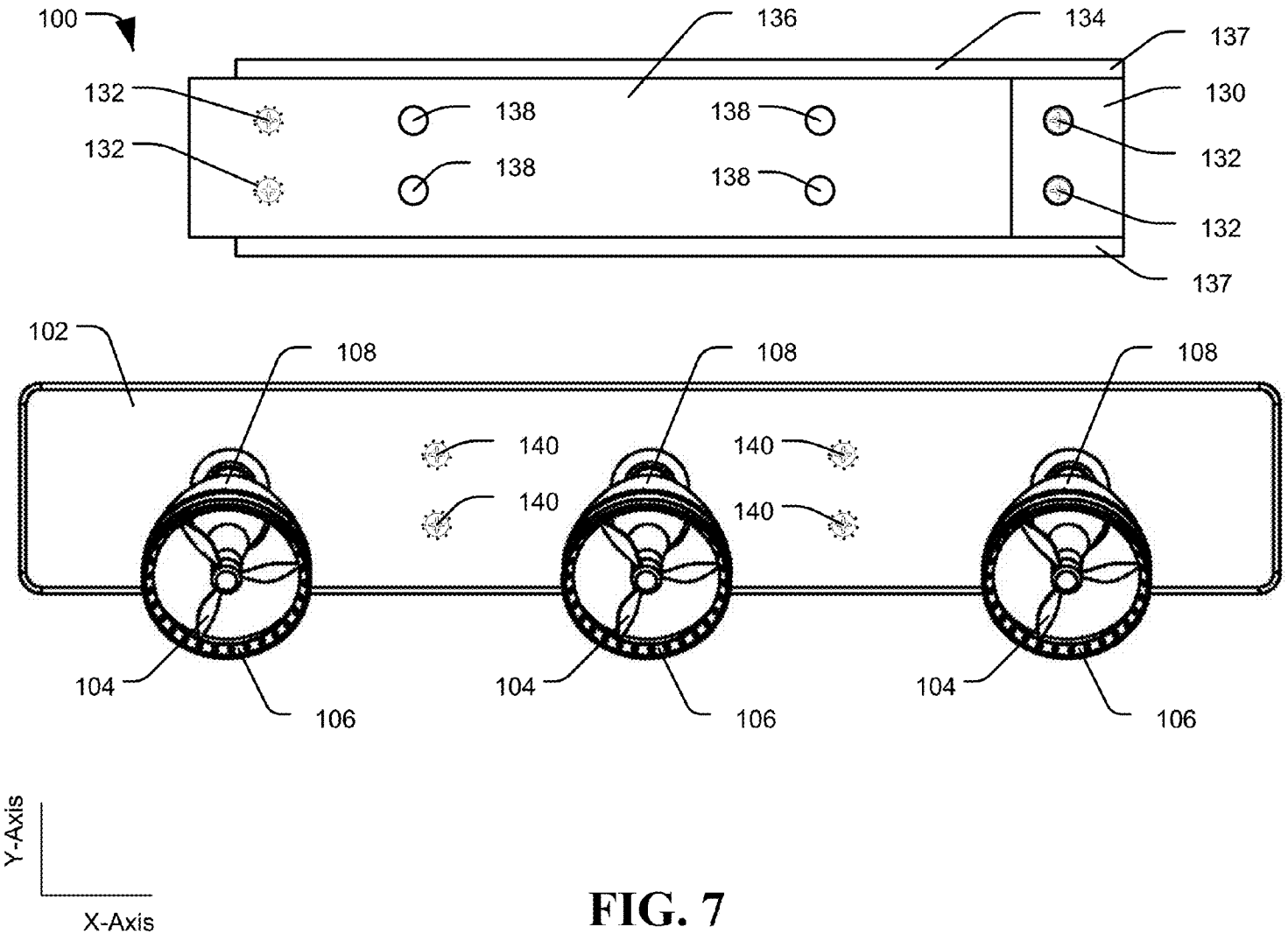
FIG. 7 is a diagram of a system including a fan and light combination, according to certain embodiments.
Figure 8:
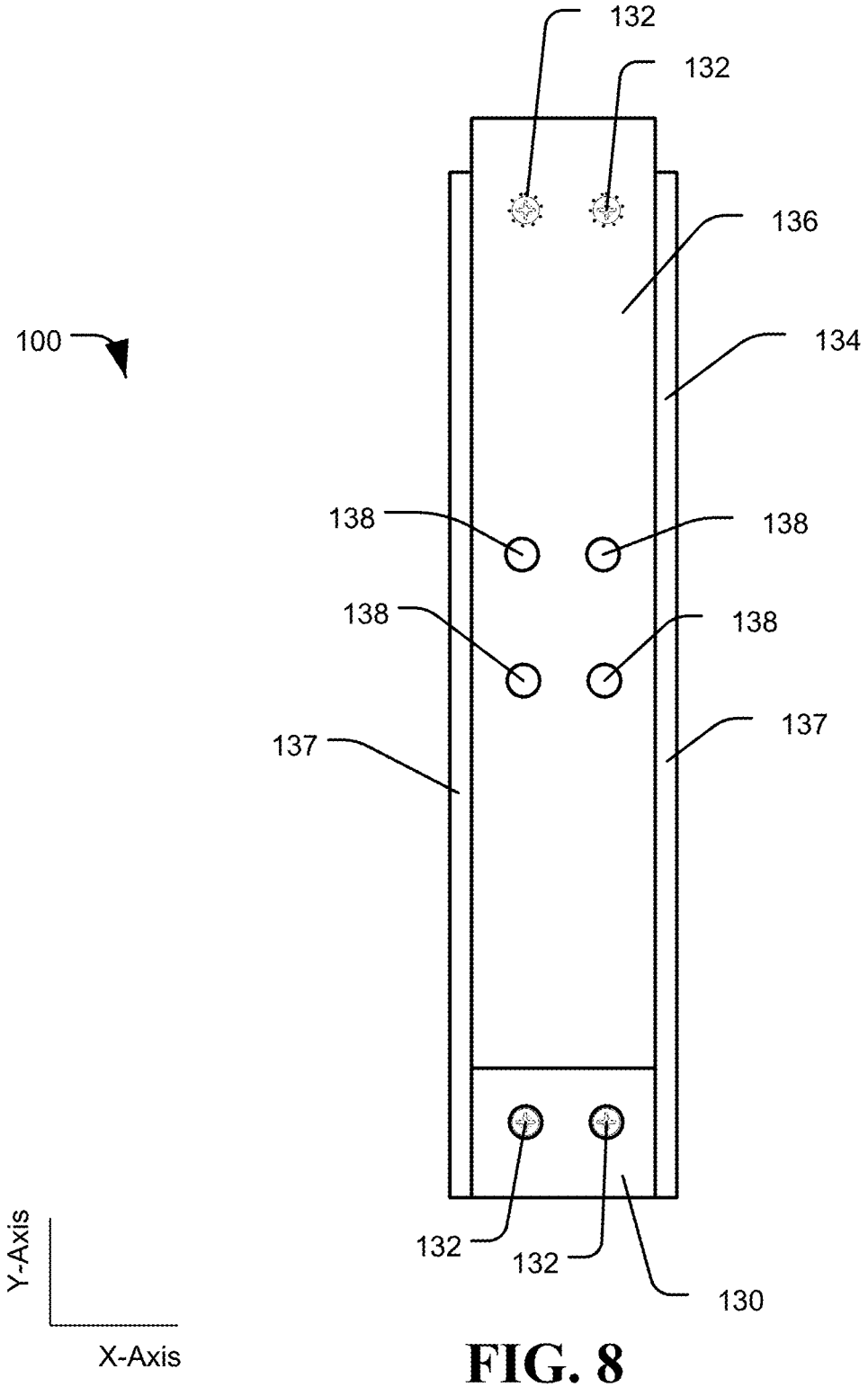
FIG. 8 is a diagram of a mounting system, according to certain embodiments, according to certain embodiments.

Referring to FIG. 7, a front view of the fan and light combination device 100 is shown along with a front view of the wall plate 134 and the sliding plate 136, in accordance with certain embodiments. The wall plate 134 can be mounted, such as on a wall, either horizontally as shown or vertically, as shown in FIG. 8.

The wall bracket 134 can be adapted to connect to a the sliding bracket 136 via a rails 135, where the rails are a portion of or connected to wall bracket 134 and overlap at least a portion sliding bracket 136 to allow the sliding bracket 136 a range of motion in at least one axis.

The wall bracket 134 can include one or more attachment mechanisms 132 to allow the wall bracket 134 to attach to a wall or ceiling (or other device). The mount 102 may directly connect to the wall bracket 134, such as in a fixed position, or may mount to the sliding bracket 136 via one or more attachment mechanisms 138, such as to provide a variable position.

The illustrations, examples, and embodiments described herein are intended to provide a general understanding of the structure of various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Moreover, although specific embodiments have been illustrated and described herein, it should be appreciated that any subsequent arrangement designed to achieve the same or similar purpose may be substituted for the specific embodiments shown.

This disclosure is intended to cover any and all subsequent adaptations or variations of various embodiments. Combinations of the above examples, and other embodiments not specifically described herein, will be apparent to those of skill in the art upon reviewing the description. Additionally, the illustrations are merely representational and may not be drawn to scale. Certain proportions within the illustrations may be exaggerated, while other proportions may be reduced. Accordingly, the disclosure and the figures are to be regarded as illustrative and not restrictive.

What is claimed is:

1. A device comprising:

a first fan and light combination member including:

a first fan;

a first housing having a generally conical shape and the first fan disposed within the first housing, the first housing having a proximate end at a narrow end of the generally conical shape, a distal end opposite the proximate end, and a housing side wall disposed between the proximate end and the distal end, wherein the distal end has a generally annular shape and includes an opening therein to allow air flow due to the first fan to pass through;

a light component having a generally annular shape and attached to the distal end of the first housing, wherein the light component allows the air flow to pass through the distal end; and a mount connected to the proximate end that includes an electrical connection to provide power to the fan and the light component.

2. The device of claim 1 further comprising a second fan and light combination member connected to the mount.

3. The device of claim 2 further comprising a third fan and light combination member connected to the mount.

4. The device of claim 1 further comprising the light component includes one or more light emitting diodes (LEDs).

5. The device of claim 4 further comprising the light component is connected to a rim of the distal end of the first fan housing.

6. The device of claim 1 further comprising the light component is connected to, and removable from, the distal end of the first housing by an attachment mechanism.

7. The device of claim 6 further comprising the attachment mechanism is a first threaded element of the light member that is adapted to thread onto a second threaded element of the first housing.

8. The device of claim 1 further comprising the mount is adapted to be attached to a vertical wall.

9. The device of claim 1 further comprising the mount is connected to the proximate end via a ball and socket connector that allows an articulable motion of the first fan and light combination member with respect to the mount.

10. The device of claim 1 further comprising a protection mechanism disposed near the distal end and adapted to allow displaced air from the fan to pass through the first housing towards the distal end.

11. The device of claim 1 further comprising the proximate end including an opening having power wires for the fan and light component passing there through.

12. The device of claim 1 further comprising a sliding bracket adapted to attach to the mount to allow a range of motion in at least one axis when the mount is installed.

13. The device of claim 1 further comprising the light component has multiple selectable settings that vary an intensity emitted from one or more light elements.

14. The device of claim 1 further comprising one or more electronic circuits adapted to connect to a wireless network, receive settings from a user device over the wireless network, and implement the settings to adjust at least one of a fan speed, a fan direction, a light intensity, or a light color.

15. A light and fan apparatus comprising:

a first fan and light combination member including:

a first housing having a first fan disposed within the first housing, the first housing having a proximate end, a distal end opposite the proximate end, and a housing side wall disposed between the proximate end and the distal end to form the first housing, wherein the distal end has a generally annular shape and includes an opening therein to allow air flow due to the first fan to pass through;

a first light component having a generally annular shape and attached to the distal end of the first housing, wherein the first light component allows the air flow to pass through the distal end;

a second fan and light combination member including:

a second housing having a second fan disposed within the second housing, the second housing having a proximate end, a distal end opposite the proximate end, and a housing side wall disposed between the proximate end and the distal end to form the second housing, wherein the distal end has a generally annular shape and includes an opening therein to allow air flow due to the second fan to pass through;

a second light component having a generally annular shape and attached to the distal end of the second housing, wherein the second light component allows the air flow to pass through the distal end; and a mount connected to both the first fan and light combination member and the second fan and light combination member.

16. The light and fan apparatus of claim 15 further comprising the first fan and light combination member is independently controllable from the second fan and light combination member.

17. The light and fan apparatus of claim 15 further comprising:

the first light component includes one or more first light emitting diodes (LEDs) and is connected to a first rim of the distal end of the first fan housing; and the second light component includes one or more second light emitting diodes (LEDs) and is connected to a second rim of the distal end of the second fan housing.

* * * * *